US005553422A

United States Patent [19]

Gazaway

[11] Patent Number: 5,553,422

[45] **Date of Patent: * Sep. 10, 1996**

[54] GLASS RESTRAINT SYSTEM FOR WINDOWS

[76] Inventor: Vaden S. Gazaway, 882 Clarkston Dr., San Jose, Calif. 95136

[ * ] Notice: The term of this patent shall not extend beyond the expiration date of Pat. No. 5,426,897.

[21] Appl. No.: 413,177

[22] Filed: Mar. 30, 1995

Related U.S. Application Data

[63] Continuation-in-part of Ser. No. 176,537, Jan. 3, 1994, Pat. No. 5,426,897 and a continuation-in-part of PCT/US95/00179.

[51] Int. Cl.[6] ..... E06B 1/04

[52] U.S. Cl. ..... 52/204.53; 52/204.62; 52/718.04

[58] Field of Search ..... 52/717.01, 718.04, 52/718.05, 772, 780, 204.53, 204.62, 204.705, 204.7, 202, 222, 96, 408

[56] References Cited

U.S. PATENT DOCUMENTS

| | | | |
|---|---|---|---|
| 4,037,372 | 7/1977 | Patry | 52/96 |
| 4,161,853 | 7/1979 | Weiss et al. . | |
| 4,566,236 | 1/1986 | Pound | 52/202 X |
| 4,586,301 | 5/1986 | Hickman | 52/96 |
| 4,665,670 | 5/1987 | van den Burg | 52/202 X |
| 4,769,877 | 9/1988 | Conley | 52/222 X |
| 5,222,343 | 6/1993 | Anderson . | |
| 5,426,897 | 6/1995 | Gazaway . | |

*Primary Examiner*—Lanna Mai
*Attorney, Agent, or Firm*—Claude A. S. Hamrick

[57] ABSTRACT

Glass restraint system for windows, including a film (102), an adhesive for affixing the film (102) to a window pane (104), and an assembly (106) for clamping the edges of the film to the window frame (100) or mullion and providing an aesthetically pleasing cap and seal around the window. The assembly (106) includes a baseplate (102) with upwardly projecting sides (206, 208), the outer surfaces of which have captivation grooves (210, 212) extending along the length of the baseplate, and an inverted trough-shaped cap (214) having a top (215) and two sides (216, 218) which fit over the baseplate. The sides of the cap are provided with inwardly protruding ribs (220, 222) on the inside faces that are configured to snap into the captivation grooves for securing the cap to the baseplate so that four segments of the cap and baseplate form a four-sided, substantially rectangular framing assembly. The cap also has at least one narrow protruding rib (224) extending inwardly on the window facing side of the cap top, the rib being configured so as to leave a small gap between the rib and the window pane. A flexible gasket (228) is engaged to the rib or ribs and used to maintain a sealing pressure against the film covering the window to prevent moisture and other contaminants from accumulating behind the cap. In alternative embodiments, a film clamping assembly (457, 503–520) is substituted for the baseplate.

19 Claims, 5 Drawing Sheets

GLASS RESTRAINT SYSTEM FOR WINDOWS

This application is a continuation-in-part of my U.S. and PCT applications entitled "GLASS RESTRAINT SYSTEM FOR WINDOWS", respectively filed Jan. 3, 1994 as U.S. Ser. No. 08/176,537 now U.S. Pat. No. 5,426,897, and Jan. 3, 1995 as PCT/US95/00179.

BACKGROUND OF THE INVENTION

1. Field of the Invention

The present invention relates generally to glass window and window wall safety systems, and more particularly to an improved system for restraining glass within an opening using a glass covering membrane in combination with an apparatus for clamping the edges of the membrane to a frame circumscribing the windowed opening.

2. Description of the Prior Art

Window film has been applied for many years to glass windows for tinting and other purposes and, due to its tensile strength, has had the incidental function of adding safety to the window in that it is difficult to tear and usually adheres to the window glass or glass fragments in the event of breakage. This is to say that if the glass becomes dislodged or is broken, the film holds the glass and/or glass particles, or at least most of the particles, in place.

In the usual application, a polyester material or film is applied to the glass and installed up to the surrounding gasket or frame. However, in Gross et al. U.S. Pat. No. 4,075,802 a film is disclosed as being adhesively secured to the plate glass, and a thin contoured strip is placed over the film edges and affixed to the window frame with wood screws. The disclosure appears to be particularly directed to residential applications having wood windows and relates to a rather primitive solution to the problem of securing the film perimeter to a window frame. However, Gross et al. do not disclose or suggest apparatus suitable for use in commercial settings wherein it is necessary that the securing system be not only functional but also aesthetically pleasing.

SUMMARY OF THE INVENTION

It is therefore an object of the present invention to provide an improved system for insuring retention of window glass in the event of its dislodgement or breakage.

It is another object of the present invention to provide an improved glass securing assembly particularly adapted for application to the common flat window frames typically used in commercial buildings.

A further object of the present invention is to provide apparatus of the type described including the use of a seal between the film covering the window pane and the edge securing means used to secure the film edges to the frame.

A still further object of the present invention is to provide a glass restraint system having particular utility for applications in high wind load environments.

Briefly, a preferred embodiment of the present invention includes a film, means for adhesively affixing it to a window pane, and a securing means for clamping the edges of the film to the window frame or mullion and providing an aesthetically pleasing cap and seal around the window. The securing means includes a trough-shaped baseplate with upwardly projecting sides, the outer surfaces of which have captivation grooves extending along the length of the baseplate, and an inverted trough-shaped cap having a top and two sides which fit over the baseplate. The sides of the cap are provided with inwardly protruding ribs on the inside faces that are configured to snap into the captivation grooves for securing the cap to the baseplate so that the cap and baseplate form a four-sided, substantially rectangular framing assembly. The cap also has at least one narrow protruding rib extending inwardly on the window facing side from the level of the cap top, the rib being configured so as to leave a small gap between the rib and the window pane. A flexible gasket is engaged by the rib or ribs and used to maintain a sealing pressure against the film covering the window to prevent moisture and other contaminants from accumulating behind the cap.

In alternate embodiments a baseplate assembly is substituted for the simple baseplate, the assembly being adapted to positively clamp the film edges and prevent dislodgement thereof in high wind load conditions.

An advantage to the present invention is that it provides a secure attachment of a window glass to a common flat window frame.

Another advantage of the present invention is that it includes a wind covering film and an aesthetically pleasing framing assembly that covers unsightly bolts or screws used in cooperation with a baseplate for clamping the film to the window frame.

A further advantage of the present invention is that it provides a positive and aesthetically acceptable seal between the film securing member and the window.

These and other objects and advantages of the present invention will no doubt become apparent to those skilled in the art after reading, the following detailed description of the preferred embodiment illustrated in the several figures of the drawing.

IN THE DRAWING

DETAILED DESCRIPTION OF THE PREFERRED EMBODIMENT

Figure 1:
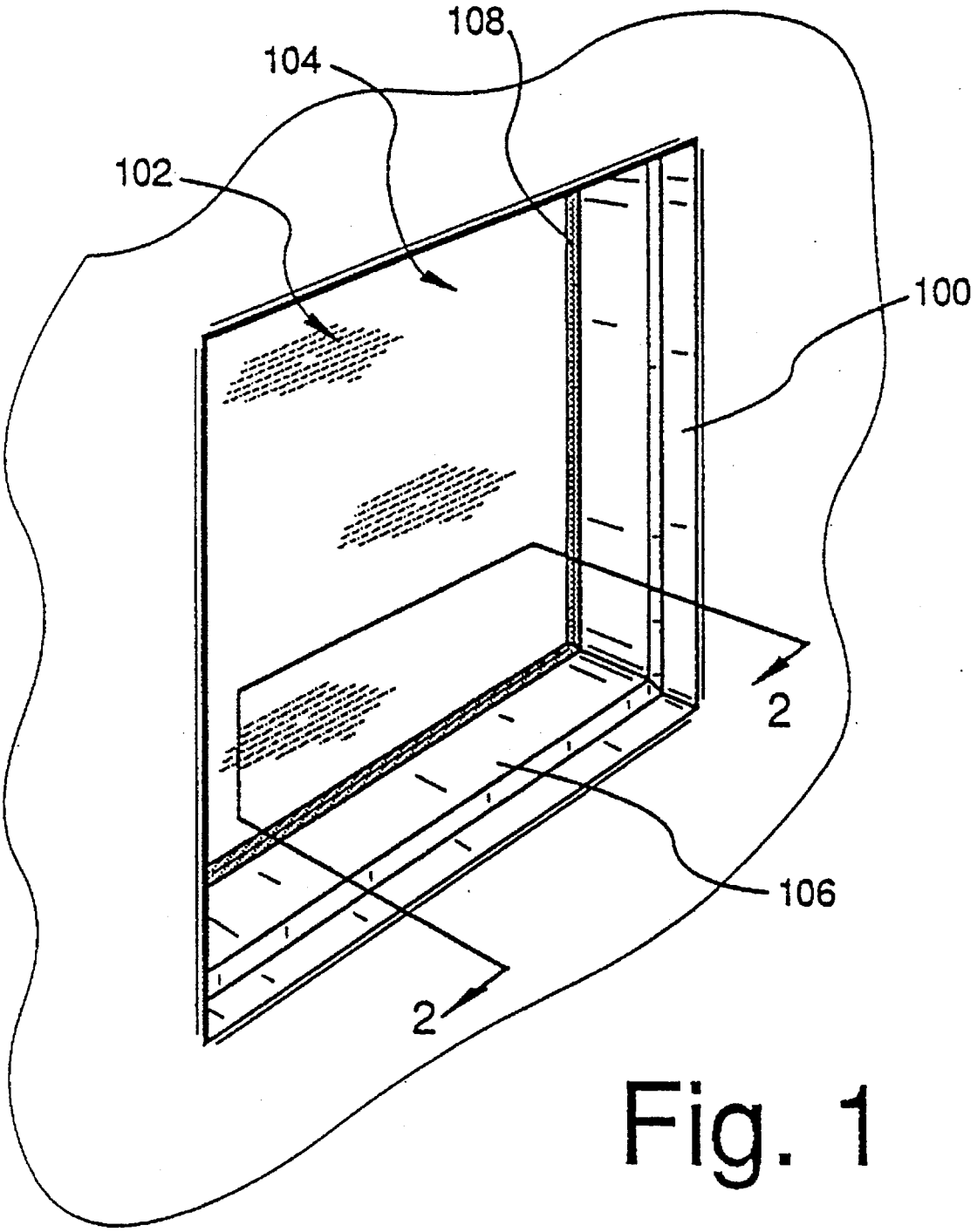
FIG. 1 illustrates the preferred embodiment of the present invention installed in a window frame.

Referring now to FIG. 1 of the drawing, there is shown a preferred embodiment of the present invention installed in a window frame 100. A film 102 is adhesively attached to a glass pane 104, the film edges being securely clamped to the window frame 100 by a securing assembly 106 in accordance with the present invention. A seal 108 is positioned between the securing assembly 106 and the film 102 covering the glass pane. The seal 108 keeps water and other contaminants from lodging between the securing assembly and the film covering the glass pane.

In operation, the film 102, being adhesively attached to the glass pane 104 as well as to the window frame, provides the benefit of retaining the pane in the event of its dislodgement from the window frame, and of retaining fragments of glass in the event the glass pane 104 is broken. The system provides protection to building occupants as well as others outside the building in the event of glass dislodgement by an earthquake, a hurricane, or an explosion, or if a projectile should break the glass, by retaining at least a high percentage of the glass particles. The system also provides resistance to projectiles and makes it more difficult for a potential unlawful entry of the building.

Figure 2A:
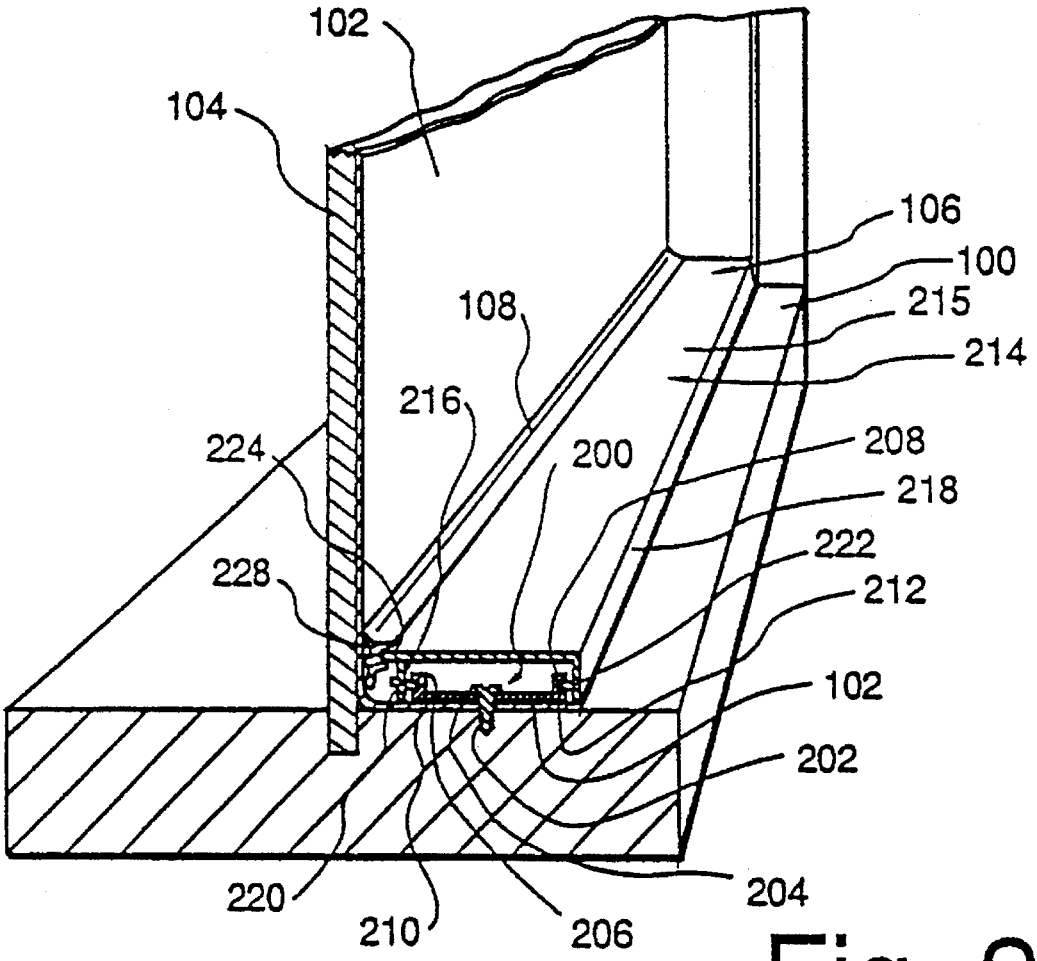
FIG. 2A shows a more detailed view and cross-section of the embodiment illustrated in FIG. 1.

FIG. 2A shows further detail of the assembly 106 and seal 108 through a view indicated by cross section line 2—2 of FIG. 1. As illustrated, the securing assembly 106 includes an elongated baseplate 200 that is positioned over the edge of the film 102 and is attached to the window frame 100 by a suitable fastening means 202, and thereby clamps the film edge 102 therebetween. The fastening means may be of the screw type or of any other well-known type including plastic or metal snap-in fasteners, rivets, etc. The baseplate 200 is preferably an extruded member having a trough-shaped cross section with a flat bottom 204, and sides 206 and 208 with grooves 210 and 212 extending the length of the plate 200.

Figure 2B:
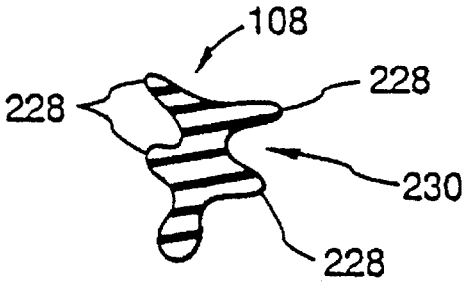
FIG. 2B is a cross-sectional view of the seal.

A snap-on cap 214, also of inverted trough shape, is defined by a top 215 and sides 216 and 218 having inwardly protruding ribs 220 and 222 which are forcibly engageable into grooves 210 and 212. At least one outwardly protruding rib 224 extends from the top 215 towards the glass pane 104 to form a capture means for the seal 108. The seal 108 is shown to have ribs 228 which bear against the film 102 (covering the glass pane 104) on one side and the cap 214 on the other side. The ribs 228 provide a captivating groove 230 for accepting the rib 224, and thereby secure and position the seal between the top 226 and film 102 covering the glass pane 104. The seal 108 is further clarified in FIG. 2B which shows a more detailed cross sectional view. Other forms of seals could of course also be utilized.

The baseplate 200 and threaded means 202 are first installed to hold the film edge 102 securely to the window frame 100. The cap 214 is then snapped in place to cover the baseplate 200 and threaded means 202. The seal 108 is thereafter forcibly inserted between the protruding edge 224 of the cap 214 and the film 102, the seal being retained by the ribs 228 in captured contact with the outwardly protruding rib 224, and serving to prevent contaminates from lodging between the securing member 106 and the film covered glass pane. Alternatively, the seal could be pre-attached to the cap 214 before it is snapped in place.

Figure 3:
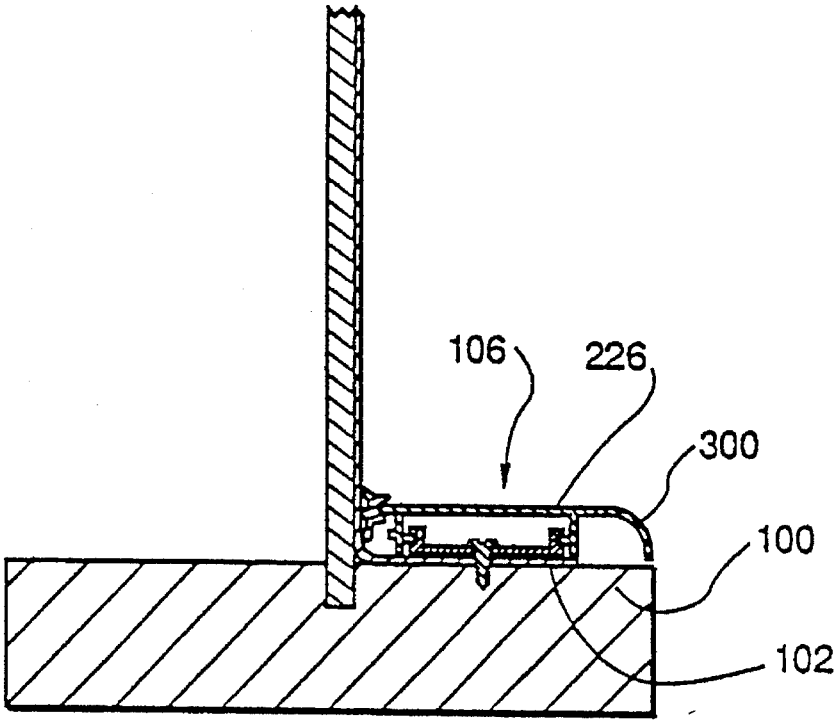
FIG. 3 shows an alternate embodiment including a modified cap having an extension to more fully cover an exiting window frame.

In FIG. 3 an alternate embodiment of the present invention is depicted including an extension 300 to the top 226 for providing full coverage of the window frame surface. The extension 300 provides a more aesthetically pleasing appearance by blending the snap on cap 106 with the window frame. It also serves as a protective cover for the frame.

Figure 4:
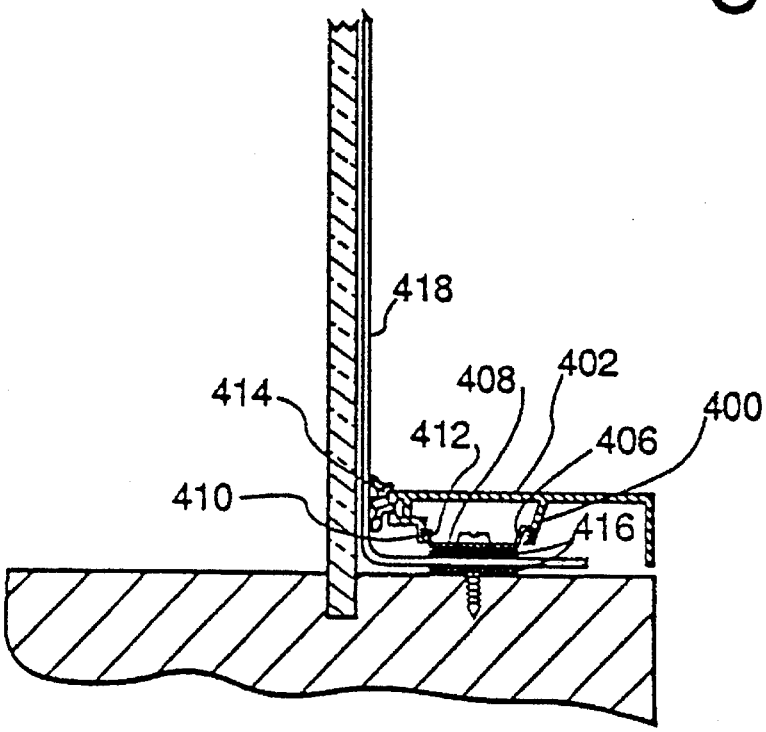
FIG. 4 shows another alternative embodiment.

Another alternative embodiment is depicted in FIG. 4 and differs from the FIG. 3 embodiment primarily in that the elongated internal rib 400 of the cap 402 and the corresponding side 404 of the baseplate 406 are slanted so that, in mating the cap to the baseplate, the rib 400 and side 406 can first be engaged and the cap rolled slightly to engage the wall 410 with the wall 412. Note also that the seal 414 is designed to be attached to the cap before it is snapped in place. This figure also illustrates the use of strips of adhesive foam tape 416 above and below the film 418 to protect it and/or to seal the edges of the film to the window frame where the film edges are not self-sticking.

Figure 5:
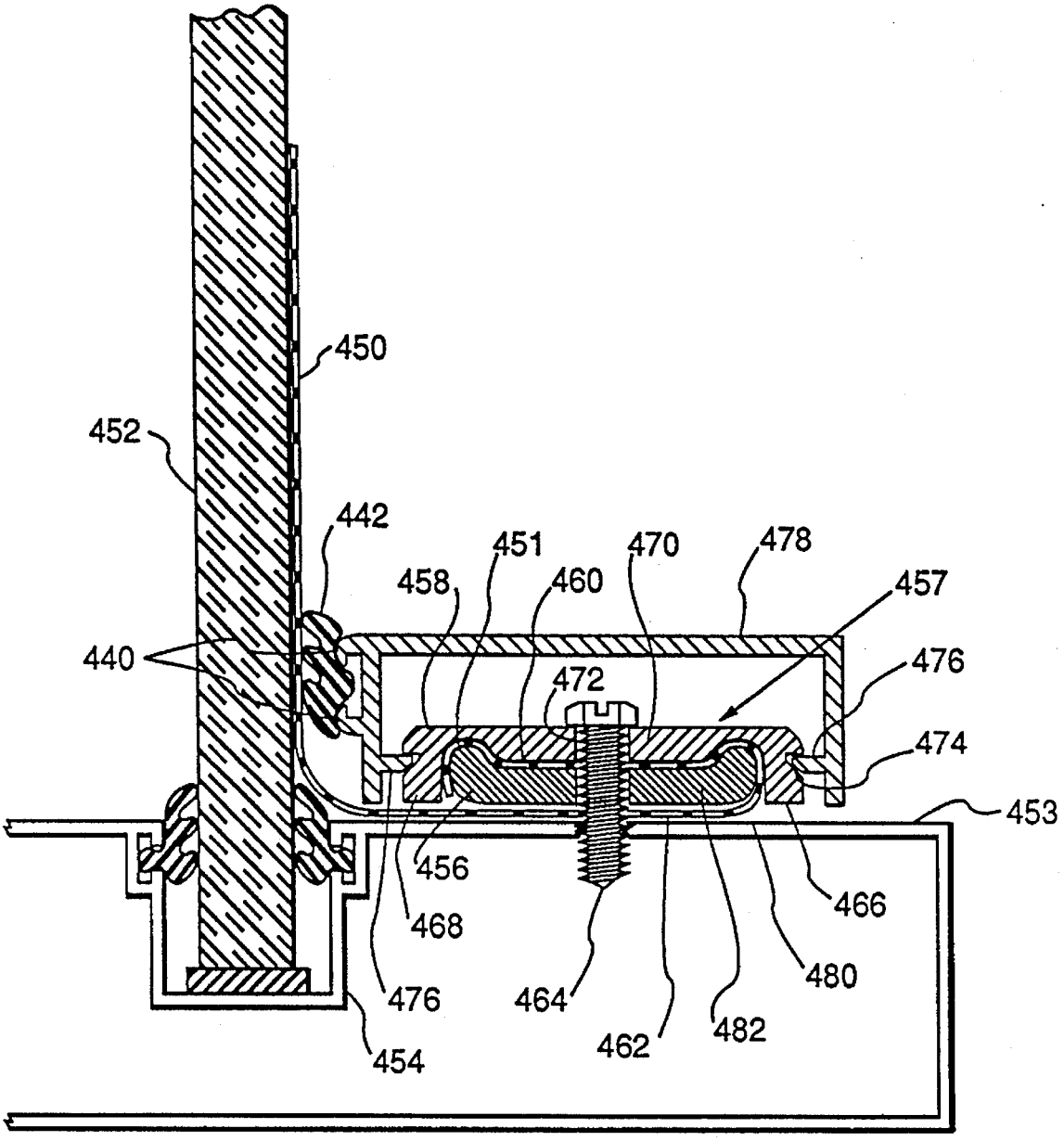
FIG. 5 depicts a further alternative embodiment.

A further embodiment of the present invention particularly suited for installation in high-wind regions is depicted in FIG. 5. In those areas subjected to hurricane and other storm-force wind conditions, it is necessary that additional means be provided to prevent the film 450 from being stripped from beneath the base plate as high winds tend to dislodge the glass pane 452 from its frame 454. In this embodiment the base plate is configured as an assembly 457 including an elongated inner member 456 and a mating outer member 458. Member 456 has a depressed central portion 460 and a plurality of apertures 462 spaced apart along its length to receive hold-down screws 464 which are screwed into the upper plate 453 of the mullion or frame 454. Matingly engaging member 456 is the outer member 458 which includes a pair of down-turned sides 466 and 468, and a thickened midportion 470 for mating with the depressed portion 460 of lower member 456. This member also includes a plurality of spaced-apart apertures 472 aligned with the apertures 462 for receiving the hold-down screws 464. Each of the down-turned sides 466 and 468 includes a longitudinally extending slot 474 for receiving the locking ribs tangs 476 of the cap strip 478. The cap strip 478 may be substantially identical to that disclosed in FIGS. 2 and 3 or have other suitable configurations. Note that, as do the caps of FIGS. 2*a*–4, cap 478 of this embodiment includes window-side facing ribs 440 for holding a seal 442 in place.

The principal difference between this embodiment and those previously described is that the base assembly is adapted to allow the edge portion 451 of film 450 to be extended beneath the lower member 456 and then wrapped thereabout as indicated, so as to be clampingly engaged between the upper member 458 and lower member 456 as the base assembly is secured to the window-framing mullion 454 by the screws 464. In this embodiment transfer adhesive 480 may be positioned beneath the film 450 so as to enhance the engagement of the film to the upper surface of mullion 454, and a similar strip of transfer adhesive 482 may be attached to the bottom of strip 456 to engage the upper surface of film 450. It will be appreciated that, as a consequence of the wedging and clamping engagement of the film edge portion 451 between the mating surfaces of members 456 and 458, it is highly unlikely that the film will be stripped from beneath the base assembly even in the highest of winds.

Figure 6:
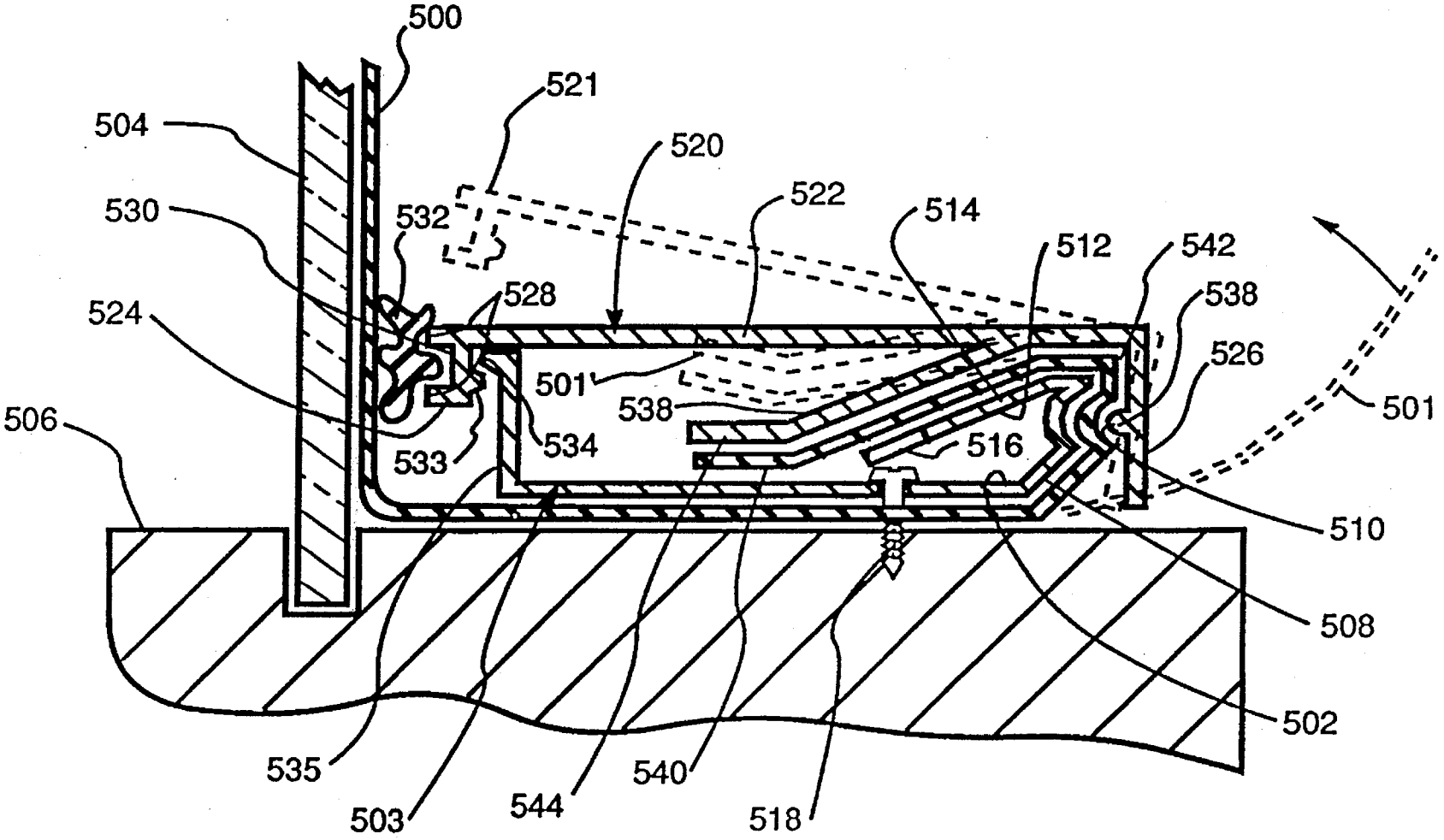
FIG. 6 depicts a still further alternative embodiment.

A still further alternate embodiment of the present invention likewise suited for installations in high wind environments is depicted in FIG. 6. In this embodiment, like that of FIG. 5, additional means are provided to prevent the film 500 from being stripped from beneath the baseplate 502 of base strip 503 as high winds tend to dislodge the glass pane 504 from its frame 506. As illustrated, the base material forming the outer sidewall 508 is inclined outwardly, deformed near its upper extremity to form a longitudinally extending groove or slot 510, and is then folded back upon itself to form an inclined member 512 having an upper film supporting surface 514. The distal edge portion of member 512 may be suitably notched as indicated at 516 and at regular intervals to provide clearance for screws or other base fasteners 518.

Disposed above base 503 is an extruded cap strip 520 having a planar upper portion 522, as illustrated, and adjoined by down-turned interior and exterior side members 524 and 526 respectively. As in the previously described embodiments the outer surface of the interior side member 524 includes at least one and preferably two outwardly protruding ribs 528 forming between them a seal engaging channel 530 for matingly receiving a rib of a flexible sealing strip 532.

The inside surface of side member 524 is provided with an inwardly protruding, longitudinally extending rib 533 adapted to snap over and lockingly engage itself beneath an outwardly protruding rib 534 formed at or near the upper extremity of base side wall 535.

The outer sidewall 526 preferably extends downwardly with its outer surface normal to the top surface of upper portion 522. Formed in the inside surface of sidewall 526 is an inwardly protruding, longitudinally extending rib 536 adapted to lockingly mate with slot 510. Extending downwardly and leftwardly, as depicted, from the lower surface of member 522 is a resilient clamping flange 538 configured to clampingly capture the folded back edge portion 540 of film 500 between its lower surface and the upper surface 514 of member 512.

As suggested by the dashed lines 501 and 521, after the film edge is clamped to the frame 506 by base 503, the excess film 501 is folded back over the top of base 503 to the position indicated at 501. Cap strip 520 is then positioned as indicated by dashed lines 521 and rotated about the base shoulder 542 until side member 524 snaps over base rib 534. Note that as strip 520 rolls over shoulder 543, film edge 501 is engaged by flange 538 and deformed downwardly thereby until strip 520 lockingly engages base 503. Flange 538 is preferably flared downwardly so as to extend more deeply than the height of side wall 535, so that its distal edge portion 544 resiliently bottoms out against base plate 502 sandwiching the film edge therebetween just before cap strip 520 snaps into its locked position with rib 536 locked in slot 510 on one side and rib 533 locked beneath rib 534 on the other side. This clamping engagement will secure the film edge between the base and cap strips even under high wind loads.

Note that forces applied to film 500 tending to pull it from beneath base 503 will be transferred to cap 520 as the film tries to unseat rib 536 from slot 510. However, it will be apparent that such rightward force (as illustrated) will tend to bias cap 520 rightwardly effecting an even tighter lock between ribs 533 and 534, and increasing the clamping engagement of the film between flange 538 and member 512. If the film side facing windowpane 504 is coated with adhesive all the way to its edges, of if strips of transfer adhesive are used, the adhesive coated surfaces clamped between flange 538 and member 512 will be adhesively secured thereto.

The objective of this embodiment is, like that depicted in FIG. 5, to better secure the film edges to the window frame by folding it back over the base strip and clamping it between the base strip and the cap strip. While two embodiments accomplishing this objective are illustrated, it is understood that many other folding and clamping configurations could be used. The configuration depicted in FIG. 6 is preferred because during installation, rotation of cap 520 into place aids in the folding of the somewhat stiff film material over the base strip and does not allow the film edge to bunch up under the cap.

Although several alternative embodiments of the present invention have been described above, it will be appreciated that certain alterations and modifications thereof will become apparent to those skilled in the art. For example, a similar structure and assembly could be used to secure glass panes within doors. It is therefore intended that the appended claims be interpreted as covering all such alterations and modifications as fall within the true spirit and scope of the invention.

What is claimed is:

1. A glass restraint system for securing a sheet of glass within a frame comprising:

a sheet of flexible plastic film for covering the sheet of glass to be restrained, the film being larger in dimension than the glass sheet so that each edge thereof extends beyond each edge of the glass sheet;

baseplate means having one or more segments with an accumulated length substantially equal to the perimeter of the glass-containing frame and having first and second opposing baseplate sides with captivating grooves running along a substantial part of the length of said baseplate means, said baseplate means being configured to sandwich the bordering portions of the film between it and the frame;

fastening means for fastening said baseplate means to the frame to clamp said bordering portions between said baseplate means and the frame;

cap means of an elongated trough-like shape and of a length sufficient to cover said baseplate means, said cap means having a top portion, a first skirt portion extending from one side of said top portion and having an outer surface facing the glass sheet, and a second skirt portion extending from an opposite side of said top portion, said first and second skirt portions having inwardly protruding ribs configured to be forcibly engaged with said captivating grooves of said baseplate means, whereby the film can be securely fastened between said baseplate means and the frame by said fastening means and said cap means can be snapped into covering engagement with said baseplate means.

2. A glass restraint system as recited in claim 1 and further comprising an adhesive for adhesively affixing said film to the glass sheet.

3. A glass restraint system as recited in claim 2 and further comprising an elongated sealing means for placement in a space separating said first skirt portion and the film covering the glass sheet so as to provide a seal therebetween.

4. A glass restraint system as recited in claim 3 wherein said sealing means includes a securing groove formed along one side thereof and wherein said cap means further includes at least one narrow rib extending outwardly from said outer surface of said first skirt portion for mating with said securing groove to retain said sealing means within the space between said cap means and the covered glass sheet.

5. A glass restraint system as recited in claim 4 wherein the top portion of said cap means extends beyond said second skirt portion to form a decorative skirt substantially covering a portion of the surface of the frame not engaged by said baseplate means.

6. A glass restraint system as recited in claim 3 wherein said sealing means includes a rib running the length thereof and wherein said outer surface of said skirt portion includes a slot extending along the length thereof for receiving said rib to retain said sealing means in the space between said cap means and the covered glass sheet.

7. A glass restraint system as recited in claim 1 and further comprising a strip of resilient material affixed to said baseplate means to cushion the engagement between said baseplate means and bordering portions of said film.

8. A glass restraint system as recited in claim 1 wherein at least one of said first and second skirt portions lies in a plane that is not normal to the plane of said top portion.

9. A glass restraint system as recited in claim 1 wherein said baseplate means has a first clamping surface facing said cap means and one of its sides configured to permit the bordering portions of the film to be folded back over the base plate means and to be additionally sandwiched between said first clamping surface and the cap means.

10. A glass restraint system as recited in claim 9 wherein said cap means includes means forming a second clamping surface facing said baseplate means for engaging the folded back film edge and sandwiching it between said first clamping surface and said second clamping surface.

11. A glass restraint system as recited in claim 1 wherein said base plate means includes a first member having a first film-engaging surface for engaging a first part of said bordering portion of said film, and having a second film-engaging surface, and a second member having a third film-engaging surface configured to mate with said second film-engaging surface, the outer extremities of said film-bordering portion being wrapped about one side of said first member and folded back over said first member so as to be sandwiched between said second and third film-engaging surfaces, said first and second members being drawn together by said fastening means to clampingly engage said outer extremity of said film.

12. A glass restraint system as recited in claim 11 wherein said second film-engaging surface of said first member and said third film-engaging surface of said second member are respectively formed such that one has a depression and the other has a protrusion for mating with said depression so as to enhance the clamping of said outer extremity of said film therebetween.

13. An edge securing system for clamping the edges of a film, used for covering a window pane, to a window frame comprising:

baseplate means having one or more segments with an accumulated length substantially equal to the perimeter of a window frame and having first and second opposing baseplate sides with captivating grooves running the length of said baseplate means, said baseplate means having a plurality of mounting holes extending therethrough and distributed over the lengths of the segments, said first side including a slot extending along the length thereof for receiving a portion of an elongated flexible gasket intended to form a seal between said cap means and the film covering the window pane;

fastening means for extension through said mounting holes to clamp the film between said baseplate means and a window frame;

cap means of an inverted trough shape and of a length sufficient to cover said baseplate means and having a top portion with first and second edges running the length of said cap means, a first side extending from said first edge and having a surface intended to face the window pane, and a second side extending from said second edge, said first and second sides having inwardly protruding ribs configured to be forcibly engaged with said captivating grooves of said baseplate means;

whereby a film covering a window pane surrounded by the window frame can be securely fastened between said baseplate means and the window frame by said fastening means, and said cap means can be snapped into place to secure and cover said baseplate means and said fastening means leaving a gap between said cap means and the portion of the film covering the window pane.

14. An edge securing system as recited in claim 13 wherein said cap means further includes at least one narrow rib extending outward from said first edge of said top portion into said gap and running the length of said first side; and seal means formed from an elongated strip of flexible material and adapted to engage said narrow rib and fill said gap to form a seal between said cap means and the film covering the window pane.

15. An edge securing system as recited in claim 14 wherein the top portion of said cap means is extended beyond said second side to form a skirt substantially covering the mating surface of said window frame.

16. An edge securing system as recited in claim 13 and further comprising a strip of resilient material affixed to the at least one surface of said baseplate means to cushion the engagement between said baseplate means and the film edges.

17. An edge securing system as recited in claim 13 wherein at least one of said first and second sides lies in a plane that is not normal to the plane of said portion.

18. An edge securing system as recited in claim 13 wherein said baseplate means has a first clamping surface facing said cap means and one of its sides adapted to permit the film edge to be folded back over the base plate means and to be additionally sandwiched between the baseplate means and the cap means.

19. An edge securing system as recited in claim 18 wherein said cap means includes means forming a second clamping surface facing said baseplate means for engaging the folded back film edge and sandwiching it between said first clamping surface and said second clamping surface.

* * * * *